United States Patent [19]

Simcock

[11] Patent Number: 5,012,487

[45] Date of Patent: Apr. 30, 1991

[54] INDUCTION MELTING

[75] Inventor: John H. Simcock, Droitwich, Great Britain

[73] Assignee: Inductotherm Europe Limited, Hereford & Worcester, United Kingdom

[21] Appl. No.: 423,320

[22] Filed: Oct. 18, 1989

[30] Foreign Application Priority Data

Jun. 14, 1989 [GB] United Kingdom ..... 8913620

[51] Int. Cl.[5] ..... H05B 6/06

[52] U.S. Cl. ..... 373/147; 373/148; 373/102; 219/10.75; 219/10.77

[58] Field of Search ..... 373/147, 12, 51, 47, 373/7, 102, 148, 138; 219/10.75, 10.77; 75/10.14, 10.25

[56] References Cited

U.S. PATENT DOCUMENTS 3,478,156 11/1969 Segsworth ..... 219/10.75
3,867,563 2/1975 Laflin ..... 373/148

FOREIGN PATENT DOCUMENTS 2399180 6/1978 France .
423326 1/1935 United Kingdom .
508255 6/1939 United Kingdom .
2200979 8/1988 United Kingdom .

*Primary Examiner*—Bruce A. Reynolds
*Assistant Examiner*—Tu Hoang
*Attorney, Agent, or Firm*—Seidel, Gonda, Lavorgna & Monaco

[57] ABSTRACT

An induction melting apparatus including a vessel for holding a melt of molten metal, an induction coil operatively associated with the vessel, and a power supply for providing power input to the induction coil. The power input has a melting component at a first preselected frequency for operatively holding the melt at a preselected temperature by induction heating and an agitation component at a second preselected and different frequency for agitation of the melt by inducing turbulence therein. The power supply comprises an agitation power supply circuit operatively supplying current to the coil at the second frequency, and a melting power supply circuit including a series resonant circuit through which the melting component is operatively applied to the coil at the first frequency at the same time as the agitation component is applied to the coil. Each supply circuit includes means for regulating the power input component respective thereto independently of and without affecting the other of the power input components.

15 Claims, 3 Drawing Sheets

INDUCTION MELTING

This invention relates to induction melting.

It is often desirable in induction melting, particularly but not exclusively the melting of steels and other alloys at high temperature in vacuum, to hold the molten bath at a constant preselected temperature and, at the same time, to provide stirring by causing turbulence or agitation of the melt to a required degree to ensure a homogeneous mixture as in the manufacture of alloys. The need is to provide adequate agitation to ensure speedy and efficient mixing without excessive heating of the melt so that the predetermined holding temperature is not exceeded.

One method and apparatus providing operation in the above manner is described in U.S. Pat. No. 4,850,573, assigned to the same assignee as the present invention.

The object of the present invention is to provide apparatus for induction melting which is particularly effective in operation, which can readily be adapted to heavy duty (high power input) or lighter duty (lower power input) applications which is reliable and readily controlled in operation.

According to the invention there is provided induction melting apparatus including vessel for holding a melt of molten metal, induction coil means operatively associated with the vessel, and power supply means for providing power input to the induction coil means, said input having a component at a first preselected frequency for operatively holding the melt at a preselected temperature by induction heating and a component at a second preselected and different frequency for agitation of the melt by inducing turbulence therein; the power supply means comprising an agitation power supply circuit operatively supplying current to the coil means at said second frequency, and a melting power supply circuit operatively supplying current to the coil means at said first frequency; characterised in that the melting power supply circuit includes series resonant means through which the melting power input component is applied to the coil means at the same time as the agitation power input component is applied thereto, each said supply circuit including means for regulating the input component respective thereto independently of and without affecting the other of the input components.

The agitation power input component may be single phase but is preferably multi-phase (conveniently 3-phase) and is also preferably at a lower frequency than the melting power input component.

The latter may be at a medium frequency of, for example, 150 Hz upto 10 Khz and more typically in the range 150–500 Hz while the agitation power input component may typically be at 50 Hz.

The melting power input component could be single phase but is preferably also multi-phase and typically 3-phase or phase modified on the basis of 3-phase to provide a pulse frequency which is a multiple of the 3-phase input, each phase or phase grouping of each said input component being interconnected with each other to be applied to respective sections or windings of the induction coil means.

If said inputs are on a 3-phase basis the coil means is preferably composed of three windings connected in parallel but arranged so that the adjacent windings are contra wound with respect to each other so that there is zero voltage gradient across the gaps between the windings or sections of the induction coil means.

It is also preferred that the melting power supply circuit includes a variable induction power device, preferably line isolated or utilizing a transformer for isolation from the circuitry of the induction coil means.

Some embodiments of the invention are now more particularly described with references to the accompanying drawings wherein.

Figure 1:
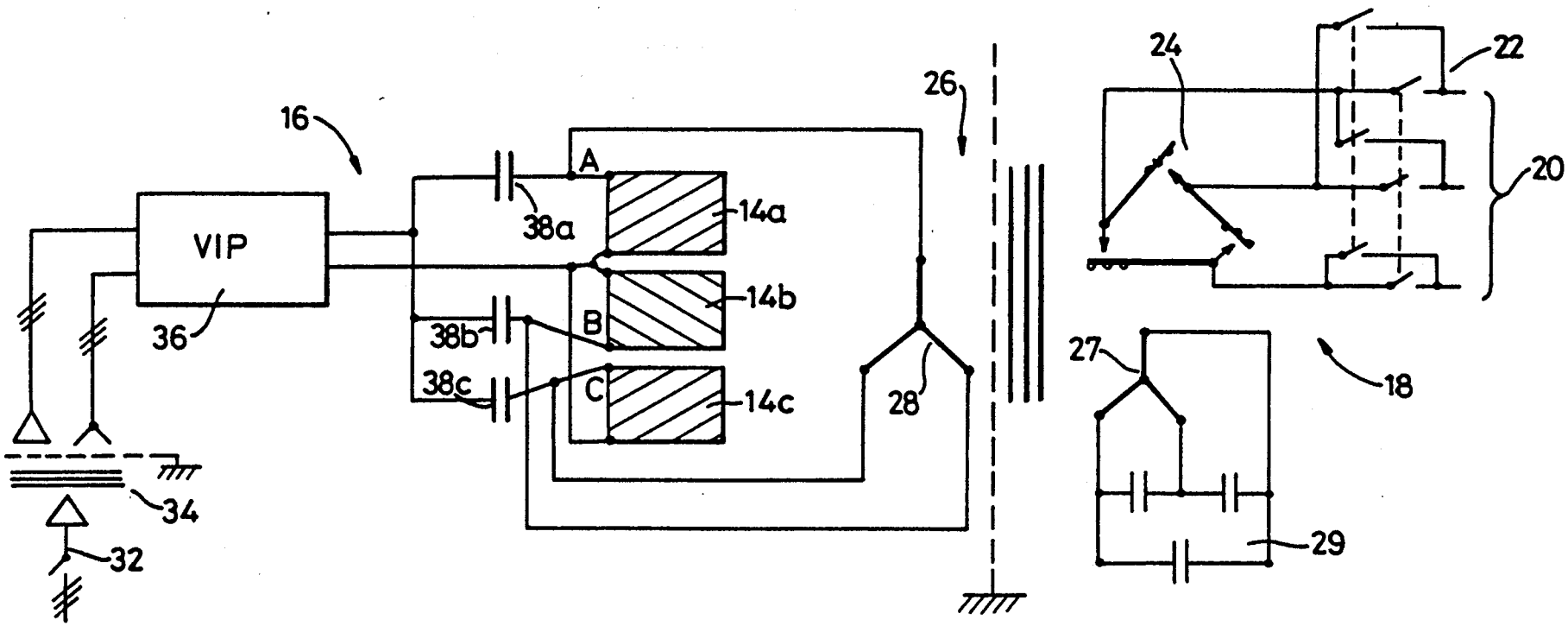
FIG. 1 is a diagram of one form of induction melting apparatus embodying the invention.
Figure 2:
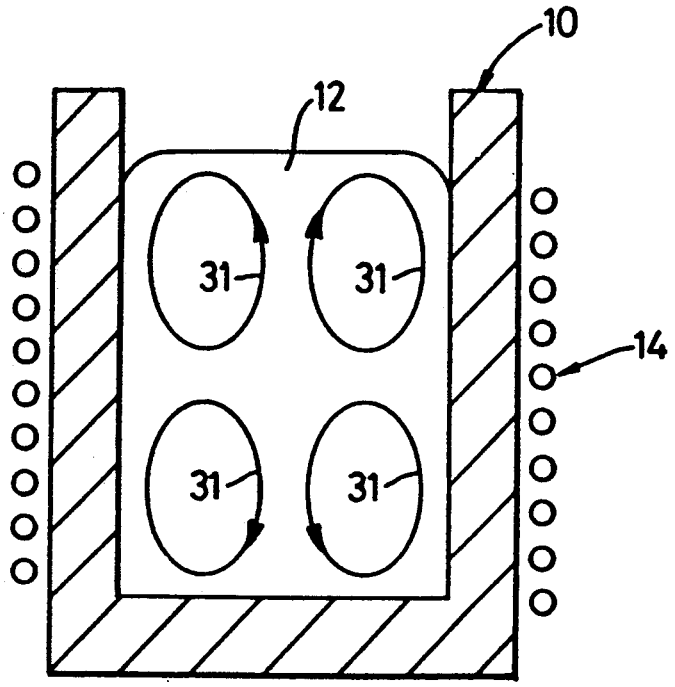
FIGS. 2 and 3 are diagrams of different modes of agitation or stirring which can be operatively induced in a melt.
Figure 3:
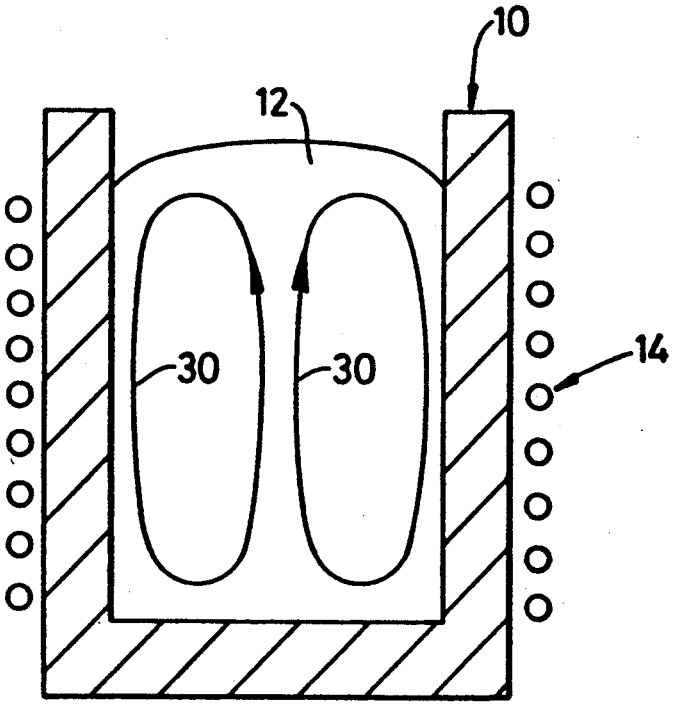

Referring firstly to FIGS. 1–3 induction melting apparatus includes a vessel 10 (not shown in FIG. 1) for holding a melt 12 of molten metal e.g. in the preparation of alloys. Induction coil means 14 is associated with vessel 10 in known manner.

This example of the apparatus operates on 3-phase based power input to the coil means 14 and the latter is divided into three sections or windings 14*a, b, c,* which are connected to operate in parallel but with each winding contra-wound in the opposite direction to the immediately adjacent winding. Thus, for example, windings 14*a* and 14*c* would be wound clockwise and winding 14*b,* positioned between them, would be wound anticlockwise. This arrangement ensures that there is zero voltage gradient across the gaps or interfaces between the windings.

The apparatus further includes power supply means consisting of separately powered and regulated agitation and melting power supply circuits indicated generally at 16 and 18 respectively to the left and right of the coil means 14 in FIG. 1.

The agitation power supply circuit 18 is generally of conventional construction. A 50 Hz 3-phase power source is input at 20 through a phase rotation/reversal contactor device 22 and a motorised or manual off-load voltage tap changer switch 24 for voltage adjustment to an earth screened transformer device 26, the output therefrom having star connection 28 feeding the coil windings 14*a, b, c,* in parallel by direct connection thereto. Transformer device 26 further includes a tertiary 3-phase winding 27 feeding a 3-phase delta connected power factor correction capacitor arrangement 29.

Winding 27 could operate at nominally 1200 v line voltage and capacitor arrangement 29 will be selected to supplement the power factor correction effect of series resonant tank capacitors in the melting power supply circuit 16 referred to hereafter.

The voltage control of transformer device 26 could be adapted to operate on-load e.g. by use of solid state variable inductors or a variable voltage transformer though the cost of such arrangement will be higher than the off-load control described above.

The application of the 3-phase agitation power input component to the induction coil means 14 will produce unidirectional stirring currents indicated diagrammatically at 30 in FIG. 3 for agitation of the melt 12. The direction of flow of the stirring currents can be reversed by changing over the contactor device 22. FIG. 3 shows one stirring or agitation mode but other modes or combination of modes are possible, FIG. 2 illustrates diagrammatically the effect of single phase bi-directional stirring currents 31 for agitation of the melt 12 and that mode may be combined with the mode shown in FIG. 3.

The melting power supply circuit 16 comprises a power input 32 from, in this example, a high voltage 3-phase 50 Hz power source (the lines individual to each phase are not shown for clarity) feeding an earth screened 3-phase bridge rectifier device 34 with star/-delta connections for phase splitting to provide 30 deg. phase shifting so that the frequency of the output therefrom is on a 12 pulse cycle. This output at medium frequency is fed to a variable induction power device 36, various forms of which will be described in greater detail hereafter and the output is split in parallel through three series resonant tank capacitors 38*a, b, c,* each connection to a respective induction coil winding 14*a, b, c,* to apply melting power input thereto. Thus medium frequency melting power is fed to the coil means 14 with simultaneous but separately controlled lower frequency agitation power, the series resonant capacitors 38 automatically block the agitation power input from affecting the variable input power device 36. Medium frequency melting power input cannot affect the transformer device 26 as the secondary terminals of the latter are effectively in parallel at medium frequency.

The tank capacitors 38 are connected in star configuration, the "neutral" being the point of excitation at medium frequency.

Figure 4:
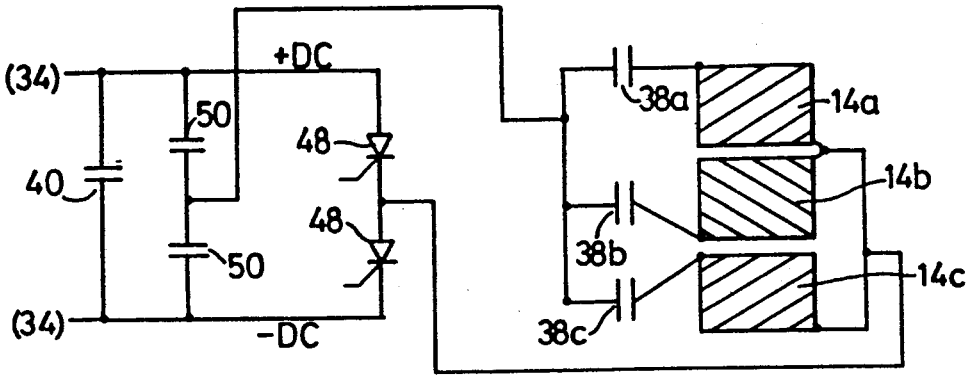
FIG. 4 is a diagram of a variable induction power device and series resonant capacitor means in a first form of melting power supply circuit.
Figure 5:
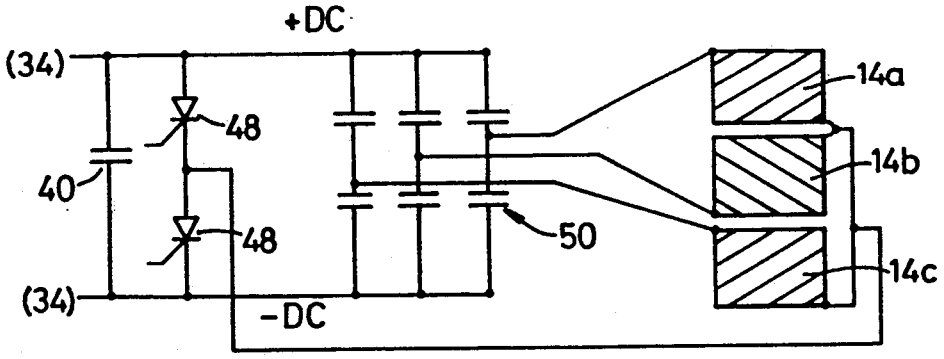
FIG. 5 is a diagram of another form of said circuit.
Figure 6:
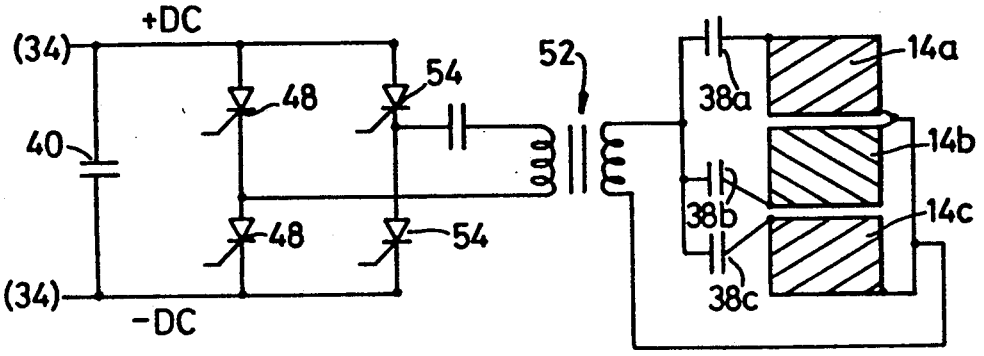
FIG. 6 is a diagram of a third form of said circuit intended for operation at a lower power level.

Referring now to FIGS. 4, 5 and 6 various alternative forms of variable input power devices 36 are shown. Output from rectifier device 34 to which the 3-phase input supply is applied and which may be a bridge solid state rectifier provides a DC potential which is applied to a filter capacitor 40 of the variable induction power devices shown. Each said device also includes switching thyristors 48 which switch the DC voltage at medium frequency for application to the three coil windings 14*a, b, c* in parallel by way of the series resonant tank capacitors 38*a, b, c* in FIGS. 3 and 5.

In the cases of FIGS. 4 and 5 the variable induction power device is line isolated as shown in FIG. 1 so that the input to the induction coil means 14 is in an electrically isolated from earth mode by means of the earth screening of devices 26 and 34.

In the case of FIG. 4 the capacitors 38 in the connections to the coil windings act as auxiliary or additional blocking capacitors (at somewhat lower voltage) supplementing the action of tank capacitors 50 on the input side of the thyristors 48.

In FIG. 5 the variable induction power device includes an alternative capacitor arrangement in the form of a three section tank capacitor 50 providing the series resonant effect.

In FIG. 6 series resonant tank capacitors 38*a, b, c* associated with the coil windings are fed from a medium frequency isolation transformer 52 which is an economical form of isolation at lower power levels, say upto 500 Kw, input to this transformer being provided from switching thyristors 48, 54 of the device 36.

The connections of coil windings 14 to the stirring power supply circuit 18 are not shown in FIGS. 4, 5 and 6 but will be as in FIG. 1.

I claim:

1. Induction melting apparatus including a vessel for holding a melt of molten metal, induction coil means operatively associated with the vessel, and power supply means for providing power input to the induction coil means, said input having a melting component at a first preselected frequency for operatively holding the melt at a preselected temperature by induction heating and an agitation component at a second preselected and different frequency for agitation of the melt by inducing turbulence therein; the power supply means comprising an agitation power supply circuit operatively supplying current to the coil means at said second frequency, and a melting power supply circuit including series resonant means through which the melting component is operatively applied to the coil means at said first frequency at the same time as the agitation component is applied thereto, each said supply circuit including means for regulating said component respective thereto independently of and without affecting the other of said components.

2. Apparatus as in claim 1 wherein at least one of the components is multi-phase.

3. Apparatus as in claim 2 wherein both the components are 3-phase.

4. Apparatus as in claim 2 wherein the multi-phase component is phase modified on the basis of 3-phase to provide a pulse frequency which is a multiple of the 3-phase input to the melting power supply circuit.

5. Apparatus as in claim 4 wherein the induction coil means includes a plurality of sections each having a respective phase of the components applied thereto.

6. Apparatus as in claim 5 wherein said sections each comprise a winding, adjacent winding of the coil being spaced apart and defining gaps therebetween, said winding being contra-wound with respect to each other whereby there is operatively zero voltage gradient across the gaps between said windings.

7. Apparatus as in claim 1 wherein the agitation component is at a lower frequency than the melting power input component.

8. Apparatus as in claim 1 wherein the melting power supply circuit includes a variable induction power device.

9. Apparatus as in claim 8 wherein said variable induction power device is isolated from circuitry of the induction coil means.

10. Apparatus as in claim 1 wherein the series resonant means include tank capacitor means.

11. Apparatus as in claim 10 wherein said tank capacitor means includes a plurality of tank capacitors connected in star configuration having a "neutral" terminal, the "neutral" being the point of excitation at a medium frequency.

12. Apparatus as in claim 10 including switching thyristors each operatively switching medium frequency DC voltage for application to respective windings of the coil means by way of respective series resonant tank capacitors comprising said tank capacitor means.

13. Apparatus as in claim 10 wherein the tank capacitor means comprises a multi-section tank capacitor.

14. Apparatus as in claim 10 wherein said tank capacitor means is fed from a medium frequency isolation transformer.

15. Apparatus as in claim 4 wherein the induction coil means includes a plurality of sections each having a respective phase grouping of the components applied thereto.

* * * * *